US009958820B2

(12) United States Patent
Numazu et al.

(10) Patent No.: US 9,958,820 B2
(45) Date of Patent: May 1, 2018

(54) IMAGE FORMING APPARATUS AND WINDING-DEVIATION PREVENTION METHOD

(71) Applicant: CASIO COMPUTER CO., LTD., Tokyo (JP)

(72) Inventors: Toshihiko Numazu, Sayama (JP); Yasuhiro Tsuyuki, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 150 days.

(21) Appl. No.: 15/005,135

(22) Filed: Jan. 25, 2016

(65) Prior Publication Data

US 2016/0236891 A1 Aug. 18, 2016

(30) Foreign Application Priority Data

Feb. 16, 2015 (JP) ..... 2015-027422

(51) Int. Cl.
*G03G 15/00* (2006.01)
*B65H 23/038* (2006.01)
*B65H 18/10* (2006.01)

(52) U.S. Cl.
CPC ..... *G03G 15/6529* (2013.01); *B65H 18/103* (2013.01); *B65H 23/038* (2013.01);
(Continued)

(58) Field of Classification Search
CPC ..... B65H 18/10; B65H 18/26; B65H 18/103; B65H 23/038; B21C 47/326; G03G 15/6529
See application file for complete search history.

(56) References Cited

U.S. PATENT DOCUMENTS 3,905,218 A * 9/1975 Galletti ..... B21C 47/063 72/148
4,795,070 A * 1/1989 Blanding ..... B65H 23/038 226/15

(Continued)

FOREIGN PATENT DOCUMENTS

JP 2008-74051 A 4/2008
JP 2010-280472 A 12/2010

(Continued)

OTHER PUBLICATIONS

Japanese Office Action dated Nov. 24, 2016 for Japanese Patent Application No. 2015-027422 and English translation of the same. (6 pages).

*Primary Examiner* — Sang K Kim
(74) *Attorney, Agent, or Firm* — Fitch Even Tabin & Flannery LLP

(57) ABSTRACT

In a front/back reversing unit, a base metal sheet having rollers attached thereon is engaged with a rotation spindle fixed to a fitting such that the base metal sheet is rotatable in a horizontal direction. When an operation of rolling up a print target medium is started and if winding tension with respect to the print target medium to be wrapped around a winding shaft becomes unbalanced, the front/back reversing unit rotates in accordance with the winding tension so as to balance the winding tension. Then, when the winding tension applied to the print target medium becomes balanced, the front/back reversing unit is returned to its original position by an elastic member, and the roller of the front/back reversing unit and the winding shaft become substantially parallel to each other.

10 Claims, 6 Drawing Sheets

(52) U.S. Cl.
CPC ..... *G03G 15/6517* (2013.01); *B65H 2404/15212* (2013.01); *B65H 2801/06* (2013.01); *G03G 2215/00455* (2013.01); *G03G 2215/0132* (2013.01)

(56) References Cited

U.S. PATENT DOCUMENTS

| | | | | | |
|---|---|---|---|---|---|
| 4,901,903 | A * | 2/1990 | Blanding | B65H 23/038 | 226/180 |
| 5,149,004 | A * | 9/1992 | Sudau | B65H 18/26 | 242/529 |
| 5,667,123 | A * | 9/1997 | Fukuda | B65H 23/038 | 226/18 |
| 6,164,201 | A * | 12/2000 | Burke | B41F 13/025 | 101/219 |
| 6,186,438 | B1 * | 2/2001 | Zeppenfeld | B21C 47/063 | 242/547 |
| 6,676,066 | B2 | 1/2004 | Keel | | |
| 8,537,415 | B2 | 9/2013 | Okura et al. | | |
| 9,359,162 | B2 | 6/2016 | Kanada et al. | | |

FOREIGN PATENT DOCUMENTS

| | | | |
|---|---|---|---|
| JP | 2014-141066 | A | 8/2014 |
| WO | 2010/087013 | A1 | 8/2010 |

* cited by examiner

IMAGE FORMING APPARATUS AND WINDING-DEVIATION PREVENTION METHOD

CROSS-REFERENCE TO RELATED APPLICATION

This application is based upon and claims the benefit of priority from the prior Japanese Patent Application No. 2015-027422, filed Feb. 16, 2015, the entire contents of which are incorporated herein by reference.

BACKGROUND OF THE INVENTION

1. Field of the Invention

The present invention relates to an image forming apparatus and a winding-deviation prevention method.

2. Description of the Related Art

Conventionally, there is an electrophotographic image forming apparatus. In this image forming apparatus, generally, the photosensitive drums of a development device are equally electrified and initialized, and latent images are formed on the photosensitive drums by optical writing and developed to toner images. Then, the toner images are directly or indirectly transferred onto a print target medium and fixed by a fuser.

In this image forming apparatus, when being rolled up after printing, paper (roll paper) ejected by a face-down method is reversed by a front/back reversing unit installed on the lower side of the paper ejection flow of the printer and then ejected face up. Subsequently, a tip end of the ejected paper is placed on the winding shaft of a rewinder, and then a rolling-up operation is started.

However, when the roll paper is to be rolled up, it is difficult to roll up the roll paper with both edges aligned without looseness, and therefore methods for rolling up roll paper with both edges aligned have been proposed. For example, Japanese Patent Application Laid-Open (Kokai) Publication No. 2008-074051 proposes a technique of rolling up by repeating a procedure in which a step roller (tension roller) is used to form slack of paper by self weight of the roller before rolling up, the rolling-up operation is stopped before the slack disappears, and then slack is formed again.

This technique can be relatively easily achieved, but there is a problem in that a space for providing a sensor and the step roller for continuously forming slack is required. In addition, there is a problem in that operations of keeping the rolling-up accuracy (with both edges aligned) high and achieving rolling up without looseness are easily affected by the positional accuracy of each section.

In another conventional known technique, for example, flanges (guides) conforming to the width of paper are arranged on a winding shaft, and the paper is accommodated between the guides by the guides being rotated along with the rotation of the winding shaft. However, in this conventional technique, there is a problem in that the positions of the flanges are required to be moved for a different paper width, which makes the structure complicated. In addition, there is a problem in that, when the paper is not accurately conveyed to the winding shaft, the edges of the paper are damaged by being forcibly accommodated between the guides.

In still another conventional technique, for example, fixed guides conforming to the width of paper are provided in an area on the upper side of a rolling-up flow, and the paper is positioned by being inserted therebetween and wrapped around a roll-up shaft. However, in this conventional technique, there is a problem in that unevenness occurs when an operator adjusts the guides to correspond to the paper width. In addition, a problem occurs depending on the positional accuracy of the paper. That is, when the paper is sent at a tilt with respect to the roll-up shaft, its position cannot be kept by the guides, and the rolling-up operation cannot be performed stably.

In yet another conventional technique, for example, an actuator is arranged on a roll-up shaft, an end of paper is detected by a position sensor or the like before the paper is rolled up, and the roll-up shaft is controlled such that the end of the paper is aligned, whereby the rolling-up operation is performed stably. However, in this conventional technique, there is a problem in that, since the roll diameter changes in the course of rolling up the paper into a roll shape, the sensor arrangement, the sensor type, and the structure become complicated to conform thereto, which extremely increases the cost.

SUMMARY OF THE INVENTION

In accordance with one aspect of the present invention, there is provided an image forming apparatus comprising: a roller which conveys a print target medium ejected from an apparatus main body; and a support section which rotatably supports the roller in accordance with tension applied to the roller via the print target medium from a direction of a winding shaft arranged in a lower flow in a conveyance direction.

In accordance with another aspect of the present invention, there is provided a winding-deviation prevention method comprising: a step of preventing winding-deviation of a print target medium ejected from an image forming apparatus with respect to a winding shaft arranged on a lower flow side of a conveyance route, by rotating a support section for supporting a roller which changes a conveyance direction of the print target medium to a direction of the winding shaft in accordance with tension applied via the print target medium from a direction of the winding shaft.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more deeply understood by the detailed description below being considered together with the following drawings.

DETAILED DESCRIPTION OF THE PREFERRED EMBODIMENTS

Embodiments of the present invention will hereinafter be described with reference to the drawings.

Figure 1:
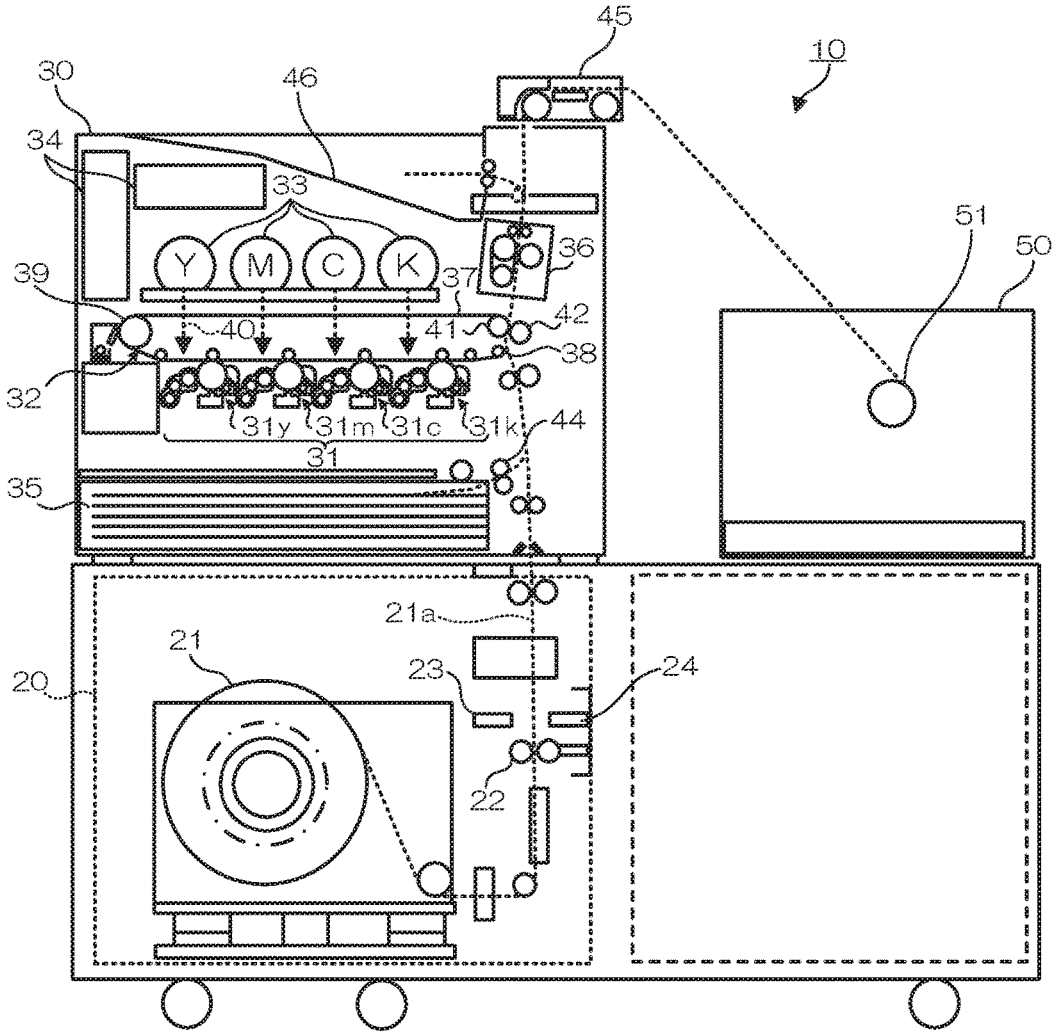
FIG. 1 is a conceptual diagram depicting the entire structure of an image forming apparatus according to an embodiment of the present invention for printing on continuous paper, such as rolled type paper (hereinafter referred to as roll paper) or flat type paper (hereinafter referred to as flat paper)

FIG. 1 is a conceptual diagram depicting the entire structure of an image forming apparatus 10 according to an embodiment of the present invention for printing on continuous paper, such as rolled type paper (hereinafter referred to as roll paper) or flat type paper (hereinafter referred to as flat paper). Note that, in the following descriptions, roll paper or flat paper serves as a print target medium 21*a*. The image forming apparatus 10 in FIG. 1 is constituted by a roll paper feeding section 20, a printer body 30, and a roll paper rolling section 50. The roll paper feeding section 20 is installed under the printer body 30, in which a paper feed roll 21 installed. The print target medium 21*a*, which is roll paper pulled from the paper feed roll 21, is supplied to the printer body 30 positioned thereabove.

Paper feed rollers 22 in FIG. 1 fix the positions of end portions of the print target medium 21*a* before it enters the printer body 30. A paper tip detecting section 23 in FIG. 1 detects a tip end portion of the print target medium 21*a* to be supplied to the printer body 30, and a paper end detecting section 24 detects end portions (end portions in a lateral direction with respect to a paper conveyance direction) of the print target medium 21*a* to be supplied to the printer body 30.

The printer body 30, which is an electrophotographic, intermediate transfer, and tandem type color image forming device, is constituted by a drum/development device 31, a transfer belt device 32, toner cartridges 33, electric equipment sections 34, a paper feeding section 35, a fixing device 36, etc.

The toner cartridges 33 are arranged above the transfer belt device 32, and the drum/development device 31 (hereinafter referred to as "development device 31") is arranged substantially directly under the transfer belt device 32. The transfer belt device 32 includes an intermediate transfer belt 37, driving rollers 38, and a follower roller 39. The development device 31 is structured such that four development devices 31*k*, 31*c*, 31*m*, and 31*y* are arranged side-by-side in multiple stages from right to left in the drawing and come in contact with the lower driving surface of the intermediate transfer belt 37 of the transfer belt device 32.

The toner of black (K), cyan (C), magenta (M), and yellow (Y) shown in the drawing as K, C, M, and Y are supplied to these development devices 31*k*, 31*c*, 31*m*, and 31*y*, respectively, from the four toner cartridges 33.

The four toner cartridges 33 are arranged above the upper running surface of the intermediate transfer belt 37, in which the toner of black (K), cyan (C), magenta (M), and yellow (Y) to be supplied are accommodated, respectively. In areas between the toner cartridges 33 and the development device 31, toner vertical conveyance paths 40 are arranged, respectively, and a fixed amount of toner is conveyed into the development device 31 from each toner cartridge 33.

Among these development devices 31*k*, 31*c*, 31*m*, and 31*y*, three development devices 31*c*, 31*m*, and 31*y* on the upper flow side (the left-hand side in the drawing) form color images on the intermediate transfer belt 37 by using the color toner of cyan (C), magenta (M), and yellow (Y) which are the three primary colors of subtractive color mixing. The development device 31*k* forms a monochrome image on the intermediate transfer belt 37 by using the color toner of black (K) which is mainly used for characters, dark portions of images, etc.

The transfer belt device 32 includes the endless intermediate transfer belt 37 positioned in a substantially center area in the printer body 30 and having a flat loop shape extending in the horizontal direction of the drawing, and the driving rollers 38 and the follower roller 39 around which the intermediate transfer belt 37 is wrapped and circularly moved in the counterclockwise direction in the drawing.

The transfer belt device 32 also includes a secondary transfer backup roller 41 which is positioned above the driving rollers 38 and around which the intermediate transfer belt 37 is wrapped. This secondary transfer backup roller 41 comes in pressure contact with a secondary transfer roller 42 via the intermediate transfer belt 37.

The print target medium 21*a*, which is conveyed to the printer body 30, comes in pressure contact with the intermediate transfer belt 37 when it is conveyed between the secondary transfer backup roller 41 and the secondary transfer roller 42. As a result, monocolor images formed on the intermediate transfer belt 37 by use of the color toner of cyan (C), magenta (M), and yellow (Y), and a monochrome image formed thereon by use of the toner of black (K) are sequentially transferred onto the print target medium 21*a* that is roll paper, and supplied to the fixing device 36.

Also, the paper feeding section 35 includes a paper feed cassette having flat paper placed therein. The flat paper (including paper having a bag-like shape such as an envelope) in the paper feed cassette is conveyed to the secondary transfer backup roller 41 and the secondary transfer roller 42 through conveyance rollers 44, as in the case of roll paper. Then, monocolor images formed on the intermediate transfer belt 37 by use of the color toner of cyan (C), magenta (M), and yellow (Y), and a monochrome image formed thereon by use of the toner of black (K) are sequentially transferred onto the print target medium 21*a* that is flat paper, and supplied to the fixing device 36.

The fixing device 36 fuses a toner image transferred onto the print target medium 21*a* that is roll paper or flat paper. Roll paper conveyed from the fixing device 36 is wrapped around a winding shaft 51 installed in the roll paper rolling section 50 via a pair of conveyer rolls not shown and a front/back reversing unit 45 (winding-deviation prevention unit). On the other hand, flat paper conveyed from the fixing device 36 is ejected face down via the conveyer rolls not shown to a paper output tray 46 arranged on the upper surface of the printer body 30.

Figure 2B:
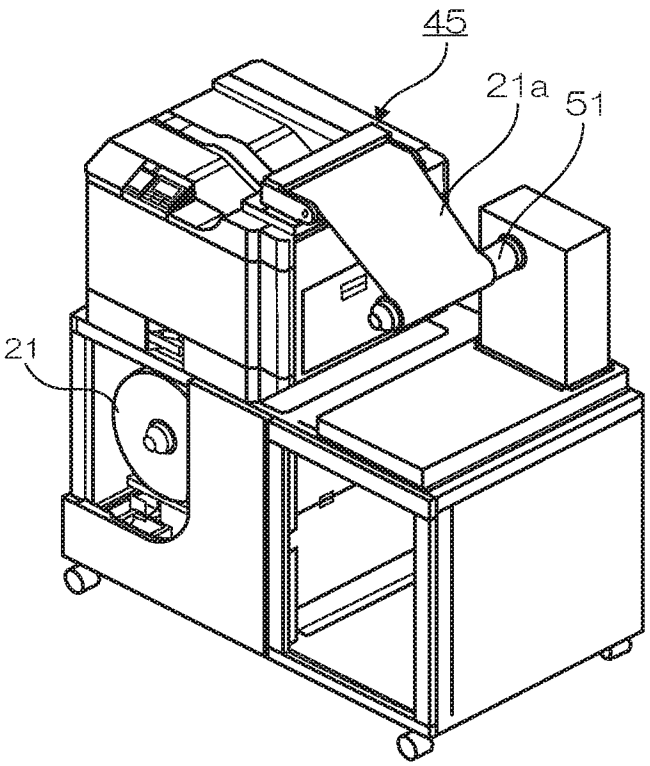
FIG. 2A and FIG. 2B are perspective views of the structure of the image forming apparatus according to the present embodiment.
Figure 2A:
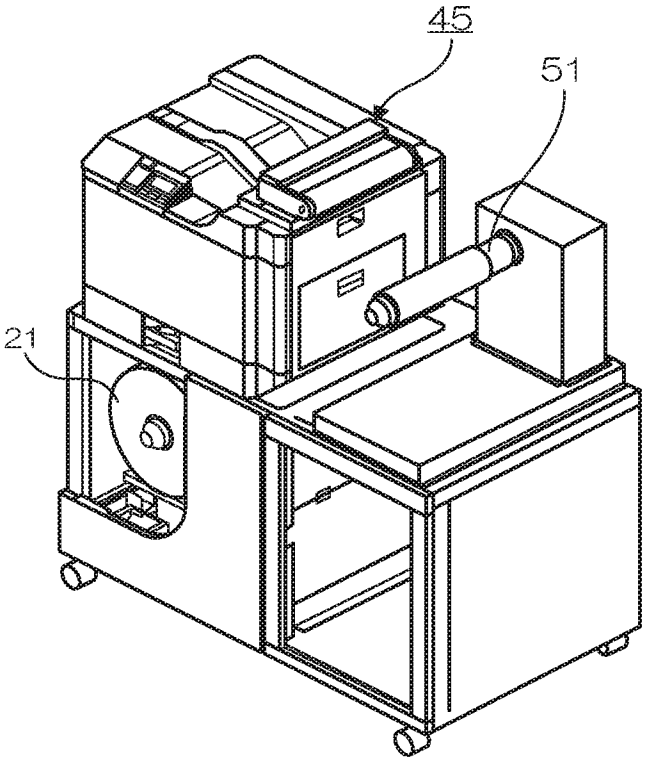

FIG. 2A and FIG. 2B are perspective views of the outer appearance of the image forming apparatus 10 according to the present embodiment. FIG. 2A depicts a state before the print target medium 21*a* that is roll paper is ejected, and FIG. 2B depicts a state where the ejected print target medium 21*a* that is roll paper is wrapped around the winding shaft 51 via the front/back reversing unit 45.

Prior to a printing operation, roll paper that serves as the print target medium 21*a* is set on the winding shaft 51. The print target medium 21*a*, which is roll paper, is pulled from the paper feed roll 21 of the roll paper feeding section 20, supplied to the printer body 30, conveyed through a conveyance path depicted in FIG. 1, and then ejected from an ejection port of the printer body 30. The print target medium 21*a* ejected from the printer body 30 is reversed (face up) via the front/back reversing unit 45, and ejected to the roll paper rolling section 50 side.

The operator manually fixes a tip end portion of the print target medium 21*a* ejected from the front/back reversing unit 45 to the winding shaft 51 on the lower flow side. The print target medium 21*a* is normally set to the winding shaft 51 by the tip end portion of the print target medium 21*a* sent from the printer body 30 being attached to the winding shaft 51 with a tape or the like. However, in some cases, the print target medium 21*a* is attached during an operation. Also, there is a case where a rolling-up operation is started after paper conveyance is once stopped and the tip end portion of the print target medium 21*a* is attached.

The roll paper rolling section 50 has a drive section which rotates the winding shaft 51, and the print target medium 21*a* is wrapped around the winding shaft 51 with appropriate tension. That is, a clutch mechanism is provided in the drive section of the roll paper rolling section 50 so that setting where the print target medium 21*a* ejected from the printer body 30 is forcibly pulled up is not made, whereby the roll paper rolling section 50 always rolls up the print target medium 21*a* with appropriate tension.

Here, since the operation of attaching the tip end portion of the print target medium 21*a* to the winding shaft 51 is manually performed by the operator, attachment accuracy may be degraded. For example, the print target medium 21*a* may not be attached straight. In this case, the tension applied to the print target medium 21*a* to be wrapped around the winding shaft 51 becomes nonuniform (unbalanced) in the lateral direction (paper width direction), whereby the print target medium 21*a* is rolled up obliquely.

In the present embodiment, means capable of always ensuring a stable rolling-up state is provided. Specifically, the attachment of the front/back reversing unit 45 to the printer body 30 is not fixed, and the front/back reversing unit 45 is structured to be rotatable around the position of attachment to the printer body 30 in accordance with the tension of the print target medium 21*a* to be wrapped around the winding shaft 51. By the front/back reversing unit 45 being structured to be rotatable as described above, the tension occurring simultaneously with the start of the rotation of the winding shaft 51 is prevented from becoming nonuniform (unbalanced) in the lateral direction (paper width direction) of the print target medium 21*a*. Also, when the tension applied in the lateral direction (paper width direction) of the print target medium 21*a* becomes balanced, the front/back reversing unit 45 (including a roller 61 described below which is opposed to the winding shaft 51) is automatically returned to a substantially parallel position with respect to the winding shaft 51. As a result, the roller 61 (described below) of the front/back reversing unit 45 and the winding shaft 51 are automatically adjusted such that they constantly keep parallelism even if the tension applied in the lateral direction (paper width direction) of the print target medium 21*a* becomes nonuniform (unbalanced).

Figure 3:
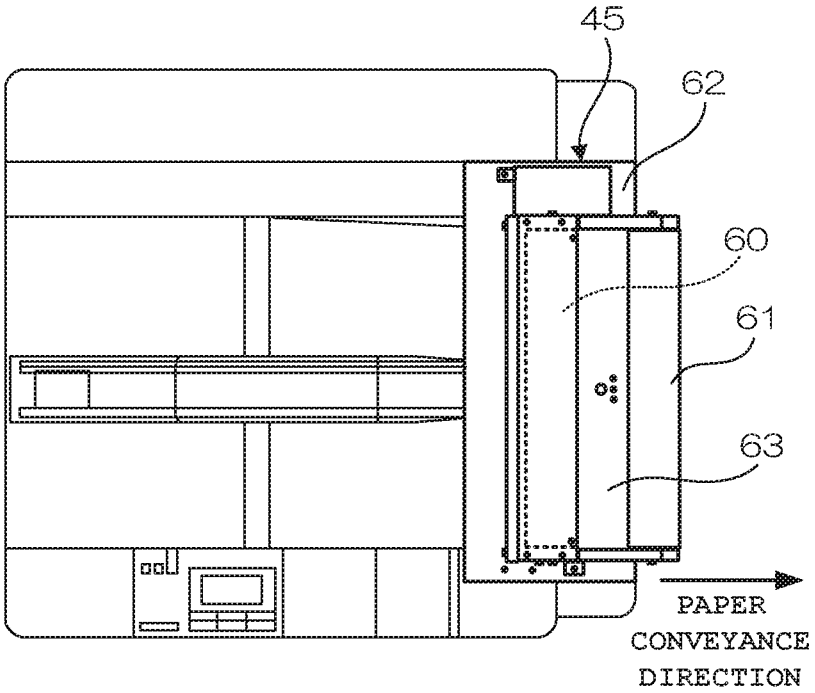
FIG. 3 is a top view of the structure of the image forming apparatus according to the present embodiment.

FIG. 3 is a top view of the structure of the front/back reversing unit 45 of the image forming apparatus 10 according to the present embodiment. The front/back reversing unit 45 includes a roller 60 on the upper flow side and the roller 61 on the lower flow side. These rollers 60 and 61 are arranged such that their axes are parallel to each other, and attached to a base metal sheet 63. The front/back reversing unit 45 is rotatably engaged with a fitting 62 fixed to the printer body 30, via this base metal sheet 63.

Figure 4:
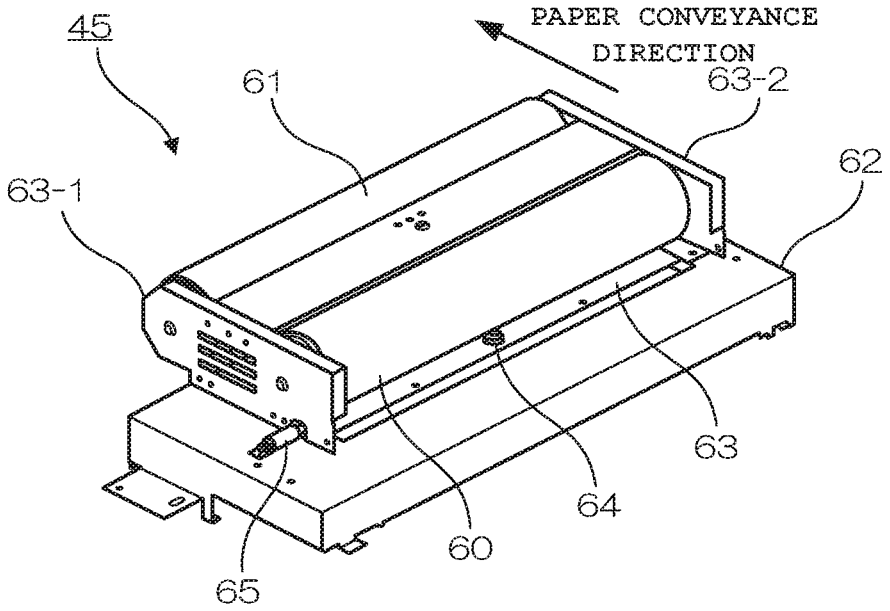
FIG. 4 is a perspective view of the structure of a front/back reversing unit (winding-deviation prevention unit) of the image forming apparatus according to the present embodiment.
Figure 5A:
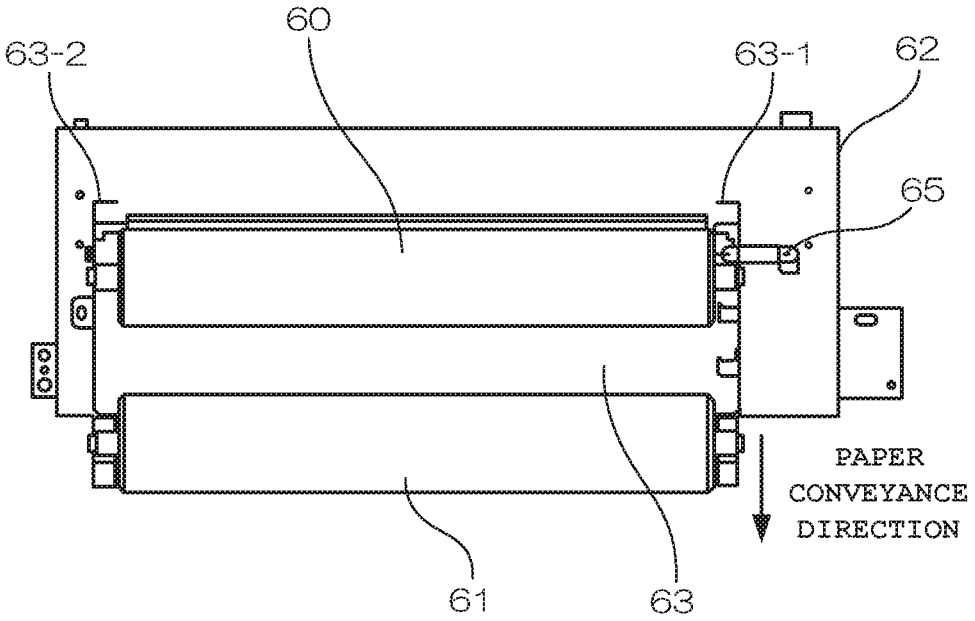
FIG. 5A and FIG. 5B are diagrams depicting the structure of the front/back reversing unit (winding-deviation prevention unit) of the image forming apparatus according to the present embodiment.
Figure 5B:
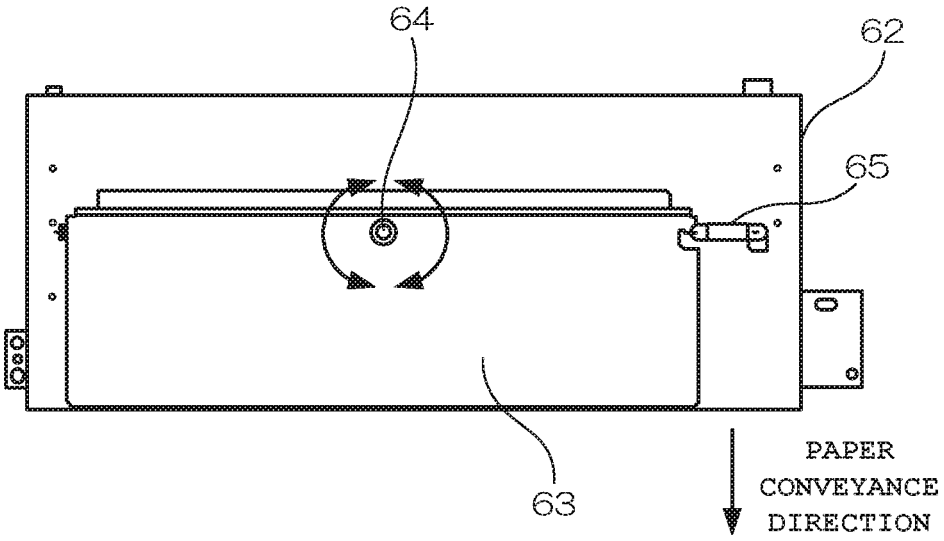

FIG. 4 is a perspective view depicting the structure of the front/back reversing unit 45 (including the fitting 62) of the image forming apparatus 10 according to the present embodiment. FIG. 5A is a top view (a view when FIG. 4 is viewed from top) depicting the structure of the front/back reversing unit 45 (including the fitting 62). Note that, in FIG. 4 and FIG. 5A, guides which are opposed to the roller 60 and guide the reversal of paper and a cover which protects (covers) an elastic member 65 have been omitted. FIG. 5B is a top view showing a state where the rollers 60 and 61 and side plates 63-1 and 63-2 which support the rollers 60 and 61 have been removed from the state shown in FIG. 5A.

The roller 60 reverses the print target medium 21*a* ejected from the printer body 30, and the roller 61 changes the conveyance direction thereof such that the reversed print target medium 21*a* is ejected to the roll paper rolling section 50 side. The base metal sheet 63 of the front/back reversing unit 45 has the side plates 63-1 and 63-2 fixed thereon which support the rollers 60 and 61. This base metal sheet 63 is engaged with a rotation spindle 64 fixed to the fitting 62 such that it is rotatable in a horizontal direction. The fitting 62 is fixed to the printer body 30. This fitting 62 and the base metal sheet 63 are engaged with each other at the rotation spindle 64 such that they are spaced by about 0.5 mm via a spacer. That is, the front/back reversing unit 45 includes a support section where the side plates 63-1 and 63-2 which support the rollers 60 and 61 are fixed to the base metal sheet 63, which is rotatably engaged with the rotation spindle 64.

As described above, by the base metal sheet 63 being fixed to the fitting 62 via the rotation spindle 64 such that it is rotatable in a horizontal direction, the front/back reversing unit 45 can rotate in a direction following a direction where winding tension occurs. Also, the fitting 62 and the base metal sheet 63 are engaged with each other by the elastic member 65. The elastic member 65 is a member having restoring force, such as a spring or rubber, and applies force to return the base metal sheet 63 rotated around the rotation spindle 64 to its original position. The original position herein is a position allowing the front/back reversing unit 45 rotated in the horizontal direction to be returned such that the roller 61 and the winding shaft 51 are parallel to each other.

Therefore, skew of the print target medium 21*a* to be wrapped around the winding shaft 51 is eliminated. When winding tension disappears, the base metal sheet 63 is returned to a substantially original position. These motions occur when tension occurs at the start of a rolling-up operation, and the tension at the time of a rolling-up operation is required to be more than force for rotating the front/back reversing unit 45. That is, a relation of $F<F'$ is required, in which F represents force required for the rotation of the front/back reversing unit 45 and F' represents the force of the winding shaft 51 in a rolling-up direction.

Figure 6A:
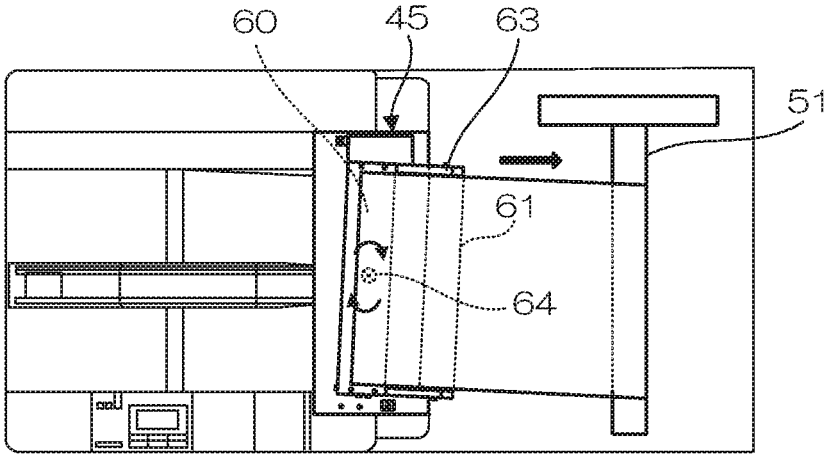
FIG. 6A and FIG. 6B are also diagrams depicting the structure of the front/back reversing unit (winding-deviation prevention unit) of the image forming apparatus according to the present embodiment.
Figure 6B:
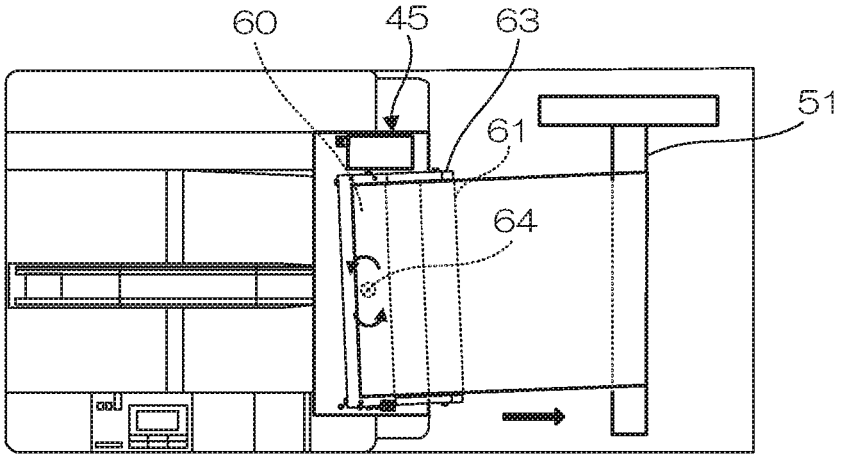

FIG. 6A and FIG. 6B are conceptual diagrams depicting an operation of rolling up the print target medium 21*a* (roll paper) in the image forming apparatus 10 according to the present embodiment. Prior to a printing operation, roll paper that serves as the print target medium 21*a* is pulled from the paper feed roll 21 of the roll paper feeding section 20, supplied to the printer body 30, and then ejected from the ejection port of the printer body 30 through the conveyance route depicted in FIG. 1. The print target medium 21*a* ejected from the printer body 30 is reversed (face up) via the front/back reversing unit 45, and then ejected to the roll paper rolling section 50 side.

The operator manually fixes a tip end portion of the print target medium 21*a* ejected from the front/back reversing unit 45 to the winding shaft 51 on the lower flow side with a tape or the like. Here, since this fixation is performed manually by the operator, if the print target medium 21*a* is obliquely attached to the winding shaft 51, the print target medium 21*a* is rolled up obliquely. For example, when the upper winding tension of the print target medium 21*a* is increased, the front/back reversing unit 45 including the rollers 60 and 61 rotates in the clockwise direction via the rotation spindle 64, as depicted in FIG. 6A.

By the front/back reversing unit 45 rotating in the clockwise direction, the winding tension applied to the print target medium 21*a* is balanced (equalized). Then, by the winding tension applied to the print target medium 21*a* being balanced, the front/back reversing unit 45 is returned to the original position by the elastic member 65. That is, the roller 61 of the front/back reversing unit 45 and the winding shaft 51 become substantially parallel to each other, and the print target medium 21*a* is wrapped around the winding shaft 51 thereafter without being skewed.

On the other hand, when the lower winding tension of the print target medium 21*a* is increased as depicted in FIG. 6B, the front/back reversing unit 45 including the rollers 60 and 61 rotates in the counterclockwise direction via the rotation spindle 64. By the front/back reversing unit 45 rotating in the counterclockwise direction, the winding tension is balanced (uniform). Then, by the winding tension applied to the print target medium 21*a* being balanced, the front/back reversing unit 45 is returned to the original position by the elastic member 65. That is, the roller 61 of the front/back reversing unit 45 and the winding shaft 51 become substantially parallel to each other, and the print target medium 21*a* is wrapped around the winding shaft 51 thereafter without being skewed.

In the above-described embodiment, in the image forming apparatus 10 having the front/back reversing unit 45 which changes face-down ejection to face-up ejection, the front/back reversing unit 45 is rotatably engaged with the printer body 30. Therefore, even if the winding tension to the print target medium 21*a* that is wrapped around the winding shaft 51 becomes unbalanced at the start of the rolling up of the print target medium 21*a*, the front/back reversing unit 45 rotates in accordance with the winding tension so as to make the winding tension balanced, and the accuracy of a rolling-up operation around the winding shaft 51 can be improved. Also, since guides which regulate the width of paper are not required, even in the case of label paper provided with an edge adhesion layer or the like, troubles due to the adhesion of an adhesive agent occurring from a constant contact with guides can be solved.

Also, in the above-described embodiment, when the winding tension is balanced, the front/back reversing unit 45 is returned to the original position by the elastic member 65 such that the roller 61 of the front/back reversing unit 45 and the winding shaft 51 are parallel to each other. Therefore, the print target medium 21*a* can be stably wrapped around the winding shaft 51 with the end portions of the print target medium 21*a* in the paper width direction being aligned, irrespective of the positional accuracy.

Moreover, in the above-described embodiment, the relation of $F<F'$ is satisfied in which F represents force required for the rotation of the front/back reversing unit 45 and F' represents the force of the winding shaft 51 in the rolling-up direction. Therefore, paper can be rolled up without looseness can be achieved.

In the above-described embodiment, the front/back reversing unit 45 is rotatably engaged with the fitting 62 fixed to the printer body 30. However, a structure may be adopted in which the front/back reversing unit 45 is directly engaged with the printer body 30 without the fitting 62.

While the present invention has been described with reference to the preferred embodiments, it is intended that the invention be not limited by any of the details of the description therein but includes all the embodiments which fall within the scope of the appended claims.

What is claimed is:

1. An image forming apparatus comprising:

a front/back reversing unit which has at least two rollers and which reverses, in a horizontal direction, a print target medium ejected in a vertical direction from an apparatus main body and which conveys the print target medium in a state where a print surface is oriented upward; and a support section which rotatably supports the front/back reversing unit around an axis that is perpendicular to a conveyance surface of the print target medium, in accordance with tension applied to the front/back reversing unit via the print target medium from a direction of a winding shaft arranged at a downstream position in a conveyance direction.

2. The image forming apparatus according to claim 1, wherein the support section is structured such that a relation of $F<F'$ where F represents force required for rotation of the support section and F' represents the tension is satisfied.

3. The image forming apparatus according to claim 1, wherein the support section includes an elastic member which applies restoring force so that the support section is returned to a predetermined orientation.

4. The image forming apparatus according to claim 1, wherein the two rollers of the front/back reversing unit comprise a first roller which receives the print target medium ejected from the apparatus main body and a second roller which sends the print target medium toward the winding shaft, and wherein the first roller and the second roller have axes parallel to each other.

5. The image forming apparatus according to claim 1, wherein the support section is rotated in accordance with a difference in winding tension at both end portions of the print target medium in a width direction with respect to the conveyance direction when the winding shaft rolls up the print target medium.

6. The image forming apparatus according to claim 1, wherein the front/back reversing unit reverses front and back of the print target medium rejected from the apparatus main body based on the tension applied from the direction of the winding shaft arranged at the downstream position in the conveyance direction.

7. The image forming apparatus according to claim 1, wherein the support section supports the front/back reversing unit such that the front/back reversing unit is rotatable with a support axis perpendicular to an axis of the front/back reversing unit as a center, in accordance with the tension applied from the direction of the winding shaft arranged at the downstream position in the conveyance direction.

8. The image forming apparatus according to claim 1, wherein the support section supports the front/back reversing unit such that the front/back reversing unit is rotatable in a horizontal direction around the axis that is perpendicular to the conveyance surface of the print target medium, in accordance with the tension applied from the direction of the winding shaft arranged at the downstream position in the conveyance direction.

9. A winding-deviation prevention method comprising:

preventing winding-deviation of a print target medium with respect to a winding shaft, by rotating, around an axis that is perpendicular to a conveyance surface of the print target medium, a support section for supporting a front/back reversing unit which has at least two rollers and which changes a conveyance direction of the print target medium ejected in a vertical direction from an image forming apparatus to a direction of the winding shaft arranged at a downstream position of a conveyance route and conveys the print target medium in a state where a print surface is oriented upward, in accordance with tension applied via the print target medium from a direction of the winding shaft.

10. The winding-deviation prevention method according to claim 9, wherein the winding-deviation of the print target medium is prevented with respect to the winding shaft, by rotating the support section in a horizontal direction around the axis that is perpendicular to the conveyance surface of the print target medium, in accordance with a direction of the tension applied via the print target medium from the direction of the winding shaft.

* * * * *